US007610777B1

(12) United States Patent
Hung

(10) Patent No.: US 7,610,777 B1
(45) Date of Patent: Nov. 3, 2009

(54) BILATERALLY BENDABLE WARP-KNIT TAPE

(76) Inventor: Da-An Hung, No. 201, Zhenxi Rd., Hemei Town, Changhua County (TW) 508

( * ) Notice: Subject to any disclaimer, the term of this patent is extended or adjusted under 35 U.S.C. 154(b) by 0 days.

(21) Appl. No.: 12/470,824

(22) Filed: May 22, 2009

(51) Int. Cl.
*D04B 21/00* (2006.01)

(52) U.S. Cl. ..... 66/195; 66/193

(58) Field of Classification Search ..... 66/195, 66/190, 192, 193; 24/391–393
See application file for complete search history.

(56) References Cited

U.S. PATENT DOCUMENTS 4,228,566 A * 10/1980 Matsuda ..... 24/393
6,076,377 A * 6/2000 Ta-An ..... 66/195
6,370,925 B1 * 4/2002 Akashi et al. ..... 66/195
6,766,669 B1 * 7/2004 Tung ..... 66/195
7,387,001 B2 * 6/2008 Wakata et al. ..... 66/195
2004/0231368 A1 * 11/2004 Matsuda ..... 66/195

FOREIGN PATENT DOCUMENTS

CN 2591060 12/2003
TW 032918 10/1980

* cited by examiner

*Primary Examiner*—Danny Worrell
(74) *Attorney, Agent, or Firm*—WPAT, PC; Justin King

(57) ABSTRACT

A bilaterally bendable warp-knit tape includes a plurality of first, second, and third braided wires. The first and second braided wires are staggered while extending circularly along a warp direction of the tape with a proper distance from left to right to form a predetermined number of wales on the tape. A span distance of lapping from left to right of the second braided wires is smaller than that of the first braided wires. More than one third braided wire is disposed in middle of the tape, and is continuously lapped while extending upward on the corresponding wale in a form of a crochet along the warp direction of the tape to form a fixing region having a predetermined width and extending along the warp direction. The fixing region is for disposing male and female buckles. The warp-knit tape has desired flexibility and extensibility on both sides for bilateral bending.

5 Claims, 5 Drawing Sheets

BILATERALLY BENDABLE WARP-KNIT TAPE

BACKGROUND OF THE UTILITY MODEL

1. Field of the Utility Model

This utility model relates to a warp-knit tape used together with buckles, and more particularly to a warp-knit tape having two sides that can be laterally bent to a certain degree without deformation.

2. Related Art

When making clothes, buttons and button-holes are usually made to engage the left and right sides of a garment. In recent years, due to the popularization of the casual style, plastic male and female buckles which are easy to buckle and unbuckle are more widely used. Therefore, the male and female buckles have been commonly used to replace the conventional buttons.

In the prior art, the male and female buckles are welded on a strap by using ultrasonic waves to form a buckling strap, and then the buckling strap is sewn on the garment at a position to be engaged, so that the garment can be buckled or unbuckled through the male and female buckles.

As an ordinary strap cannot be laterally bent, when such buckling straps are sewn at positions where lateral bending is needed, for example, at positions corresponding to the groins or armpits of the human body, the buckling straps may have wrinkles, thus affecting the appearance and comfort of the garment.

In related technical fields, though some laterally bendable warp-knit tapes have already been developed, those tapes are all designed for zippers, for example, "Warp-knit Tape for Zipper" disclosed in ROC Patent Publication No. 312918 and "Laterally Bendable Warp-knit Tape for Zipper" disclosed in PRC Patent Publication No. 2591060. In these patents, though the braided wires of the warp-knit tapes are different in structure, a sewing region having a higher strength but lacking in flexibility is disposed on one side of the warp-knit tape for sewing the zipper, and its opposite side is a portion capable of being longitudinally stretched. Such a design is not suitable for the configuration of the male and female buckles, and the structure of the braided wires that can merely be unilaterally bent cannot meet the requirements for free bending in two directions. Therefore, the above designs fail to solve the problem in the prior art that the buckling strap provided with the male and female buckles may have wrinkles.

Further, though the warp-knit tapes disclosed in the aforementioned two patent publications can be bent laterally, the structure of the braided wires at the portion that can be longitudinally stretched opposite to the sewing region is very thin and may easily become uneven on the edge of the cloth when bent. If such a warp-knit tape is used to make the inner liner of a garment, the appearance of the garment may not be affected. However, if such a warp-knit tape is used to make the outer layer of a garment, the appearance of the garment will be seriously affected.

In addition, as the soft and fit casual garments are welcome by the consumers, it is in urgent need of solutions to design a warp-knit tape applicable to the buckles and capable of being bent at will in accordance with the human engineering.

SUMMARY OF THE UTILITY MODEL

Accordingly, in order to solve the above problem, this utility model is mainly directed to a bilaterally bendable warp-knit tape in which a fixing region for male and female buckles is disposed in middle.

This utility model is further directed to maintain flatness of the warp-knit tape when the warp-knit tape is freely bent in two directions by reinforcing cloth on two sides of the warp-knit tape.

In order to achieve the above objectives, the warp-knit tape of this utility model mainly includes a plurality of first, second, and third braided wires. Each of the first and second braided wires is staggered while extending circularly along a warp direction of the warp-knit tape with a proper distance from a left side to a right side, so as to form a predetermined number of wales on the warp-knit tape. Further, a span distance of lapping from the left side to the right side of the second braided wire is smaller than that of the first braided wire, and the second braided wires on two sides of the warp-knit tape are lapped by a plurality of braided wires. More than three third braided wires are disposed in the middle of the warp-knit tape, and each of the third braided wires is continuously lapped while extending upward on the corresponding wale in the form of a crochet along the warp direction of the warp-knit tape, so as to form a fixing region having a predetermined width and extending along the warp direction of the warp-knit tape.

In this utility model, the fixing region for disposing the male and female buckles is disposed in the middle of the warp-knit tape, thereby enabling the warp-knit tape to obtain desired flexibility and extensibility on both sides for bilateral bending.

In addition, the second braided wires on two sides of the warp-knit tape are lapped by a plurality of braided wires, so as to improve the strength of the cloth on two sides and enable the warp-knit tape to maintain its flatness when bent in two directions.

The above objectives and advantages of this utility model are apparent in the following detailed description of the embodiments with the accompanying drawings.

Certainly, in this utility model, though the embodiments are described in detail below with their structures shown in the accompanying drawings, it is allowed to make some modifications or variations on the configuration or arrangement of certain parts.

BRIEF DESCRIPTION OF THE DRAWINGS

This utility model will become more fully understood from the detailed description given herein below for illustration only, and thus are not limitative of this utility model, and wherein.

DETAILED DESCRIPTION OF THE UTILITY MODEL

Figure 1:
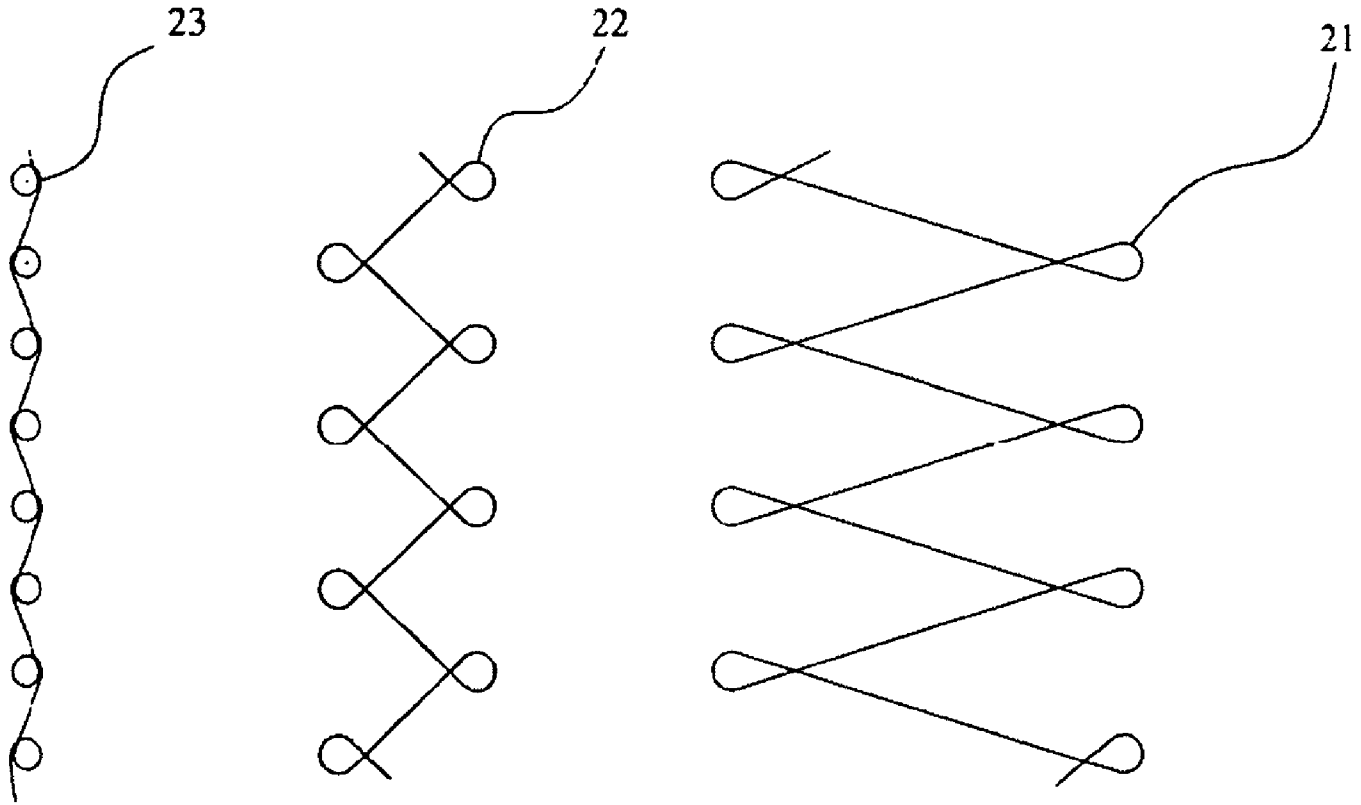
FIG. 1 is a schematic view of lapped braided wires in this utility model.
Figure 2:
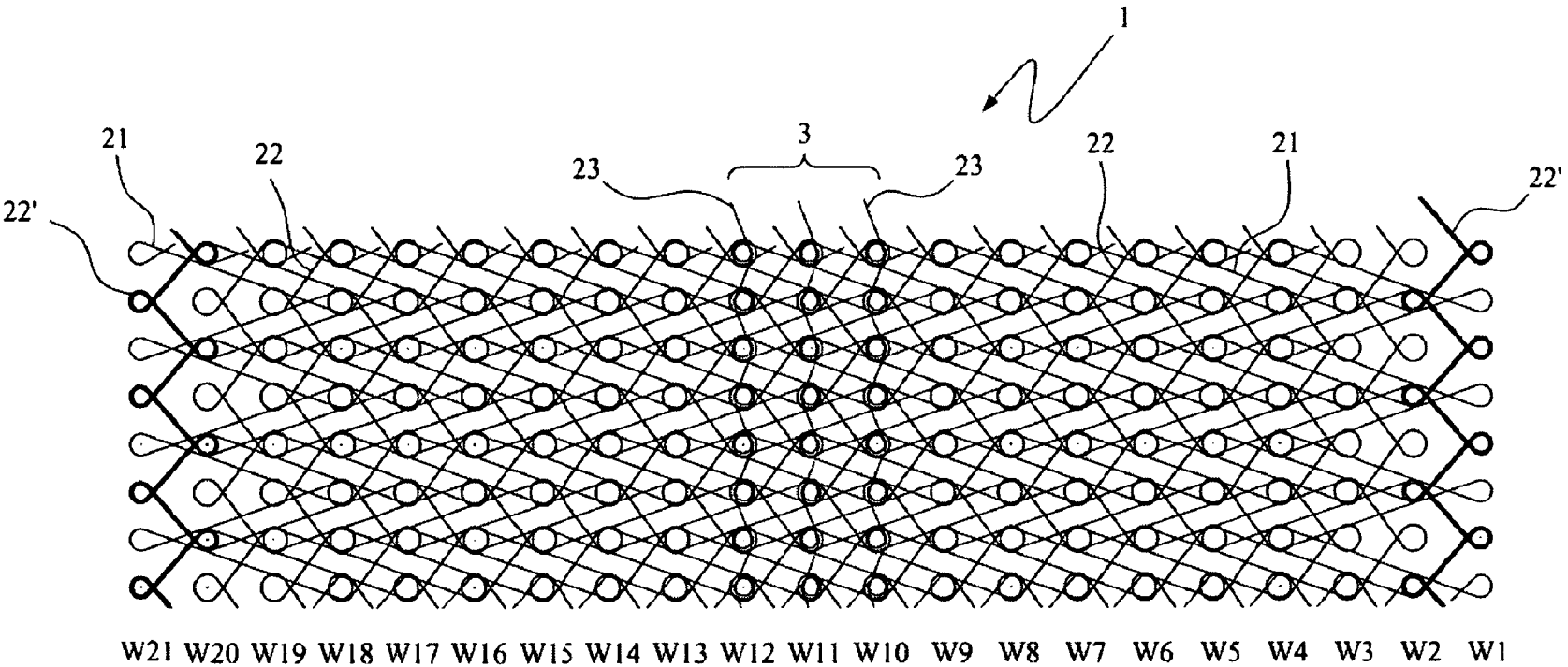
FIG. 2 is a schematic view showing a structural grain pattern of this utility model.

Referring to FIGS. 1 to 3B, the bilaterally bendable warp-knit tape disclosed in this utility model mainly includes a plurality of first braided wires 21, second braided wires 22, and third braided wires 23 made of materials such as chemical fabrics or cotton yarns.

Each of the first braided wires 21 is lapped between two wales (which are stripes slightly protruding from the surface of the warp-knit tape 1) spaced by three stitch lengths along a warp direction of the warp-knit tape 1 in a manner of being circularly staggered with consecutive two stitches respectively on a right and a left side, i.e., continuously spanning four wales. In this embodiment, altogether twenty-one wales are provided, which are respectively denoted by W1, W2, . . . , W20, and W21 in the figures; and altogether eighteen first braided wires are provided, which are respectively disposed across every two corresponding wales such as W1W4, W2W5, W3W6, . . . , W17W20, and W18W21.

Each of the second braided wires 22 is lapped between two adjacent wales along the warp direction of the warp-knit tape 1 in a manner of being circularly staggered with consecutive two stitches respectively on a left and a right side. In this embodiment, altogether twenty-one wales are provided, which are respectively denoted by W1, W2, . . . , W20, and W21 in the figures; and altogether twenty second braided wires 22 are provided, which are respectively disposed across every two adjacent corresponding wales such as W2W1, W3W2, . . . , W20W19, and W21W20. In this embodiment, the second braided wires 22' disposed on two sides of the warp-knit tape 1, i.e., disposed across the wales W2W1 and W21W20, are lapped by a plurality of braided wires (two braided wires are shown in the figures as an example), so as to improve the strength of the cloth on two sides and also maintain the flatness thereof.

Each of the third braided wires 23 extends on the corresponding wale, and is lapped up and down with a proper lapping distance (based on the direction in the figure), so as to form a plurality of crochets respectively lapped with the first and second braided wires 21, 22. In practice, the crochets can be classified into left crochets, right crochets, and central crochets, and in this embodiment the crochets formed by the third braided wires 23 are, for example, central crochets.

In this embodiment, altogether three third braided wires 23 are provided, which are respectively disposed on three adjacent wales such as W10, W11, W12 in the middle of the warp-knit tape 1 (based on the direction in the figure), so as to form a fixing region 3 with a proper width, and a distance between the two sides of the fixing region is equal to that of the warp-knit tape. In practice, the number of the third braided wires 23 varies with the size of the buckles, and the larger the buckles are, the greater the number of the required third braided wires will be.

The fixing region 3 has an effect of closely combining the first, second, and third braided wires 21, 22, 23, and thus achieves a high strength and low extensibility for engaging male and female buckles 4, so as to stabilize the male and female buckles 4 and prevent the warp-knit tape 1 from deformation. Moreover, the fixing region 3 is located in the middle of the warp-knit tape 1, and the structures of the warp-knit tape 1 on the left and right sides are loose and the wires intersect each other, so that annular arc distances on the upper, lower, left, and right sides of the formed wire loops are adapted to produce a proper extensibility. Meanwhile, as two sides of the warp-knit tape 1 are not restricted by the third braided wires 23 in the warp direction, no matter the warp-knit tape and the male and female buckles are placed at bent portions of the human body, or the movements or stretches of the user force the warp-knit tape 1 to bend leftward and rightward, the warp-knit tape of this utility model may be bent and extend correspondingly without causing wrinkles or deformation.

Figure 3A:
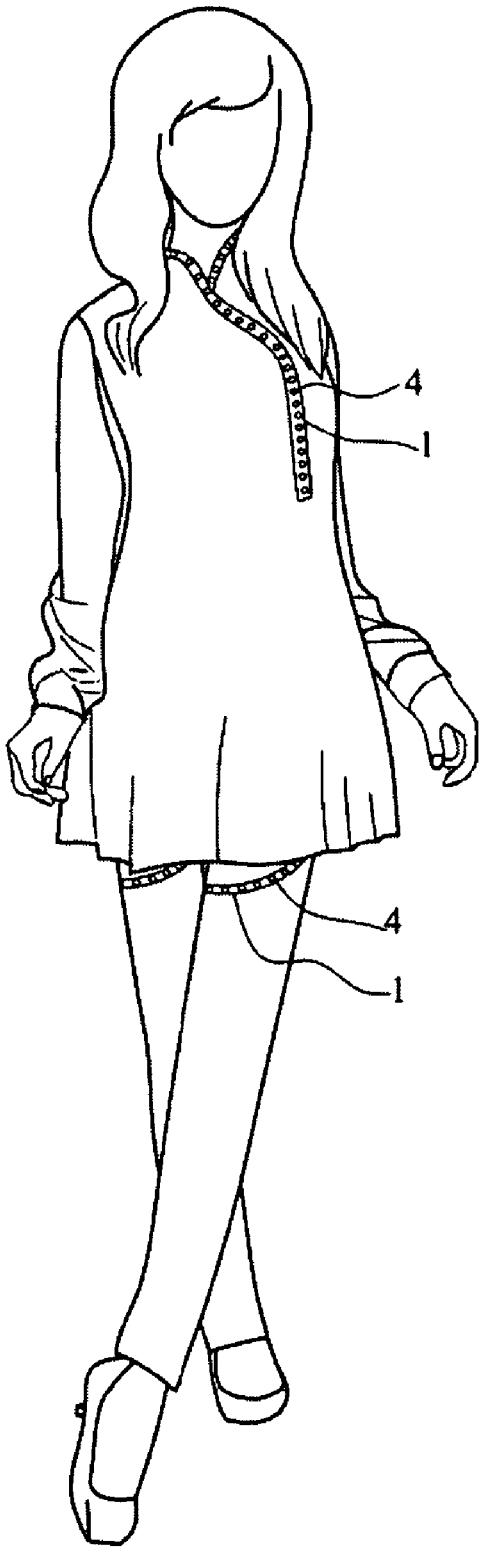
FIG. 3A is a first schematic view of an implementation aspect in which a warp-knit tape of this utility model is used together with buckles.
Figure 3B:
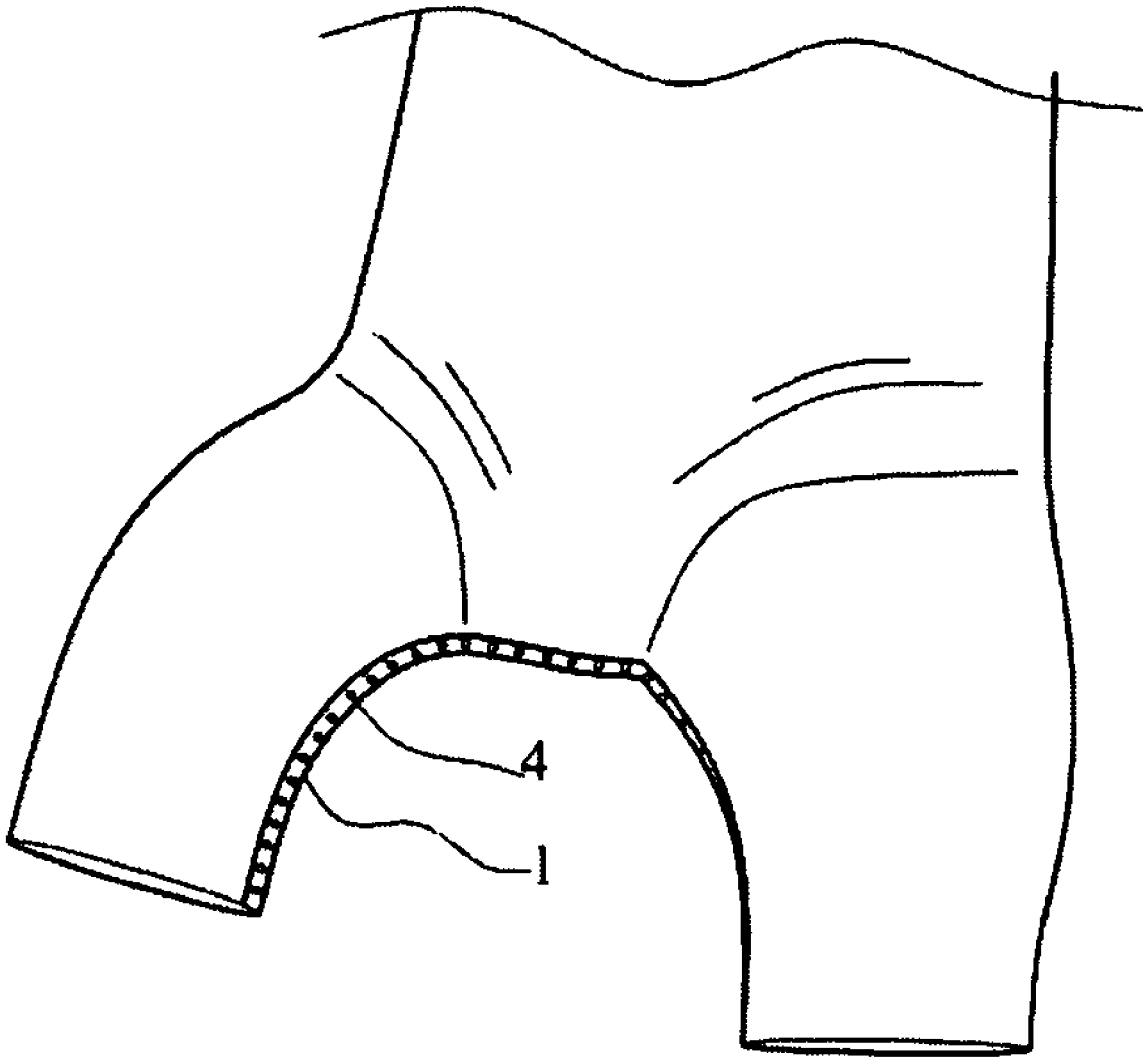
FIG. 3B is a second schematic view of an implementation aspect in which a warp-knit tape of this utility model is used together with buckles.

Therefore, the warp-knit tape 1 of this utility model used together with the male and female buckles can be bent along the body curve or bent freely with the movements and stretches of the human body, so as to meet the requirements of the human engineering and make the clothes more fit. Referring to FIG. 3A, the warp-knit tape 1 used together with the male and female buckles 4 is disposed on the slanting front of the coat or the legs of trousers, and such an implementation aspect is applicable to nursing coats, cheong-sams, or trousers. Further, referring to FIG. 3B, the warp-knit tape 1 used together with the male and female buckles 4 is disposed at the crotch opening part of a baby one-piece. In the above implementation aspects, the warp-knit tape 1 of this utility model is made fit and bent in accordance with the human engineering.

Moreover, in this utility model, in order to maintain the flatness of the warp-knit tape 1 when bent, the second braided wires 22 are particularly lapped by a plurality of braided wires (two braided wires are shown in the figure as an example) at the edge of the cloth on two sides of the warp-knit tape 1. Thereby, the second braided wires 22 at the edge of the cloth on two sides of the warp-knit tape achieve a higher strength, so as to maintain its flatness and prevent deformation.

Figure 4:
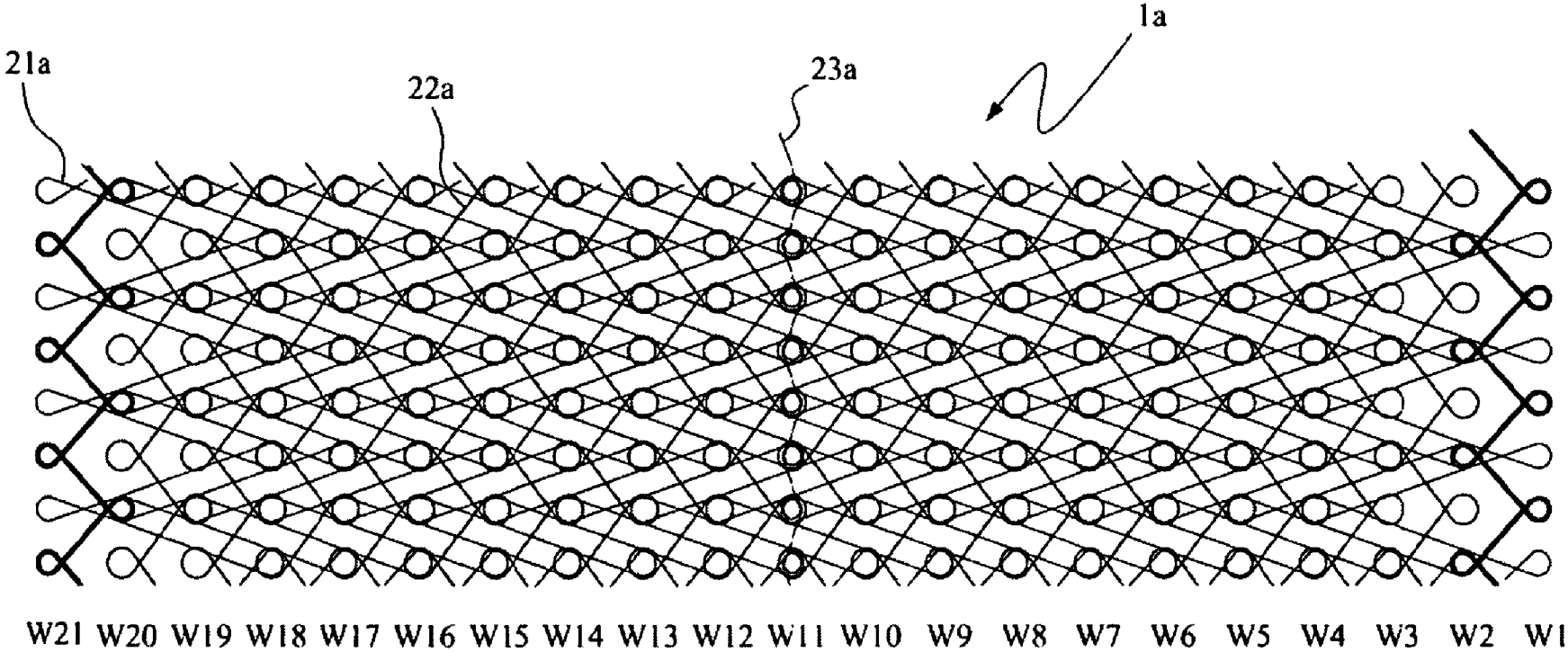
FIG. 4 is a schematic view showing a structural grain pattern according to a second embodiment of this utility model.

Further, referring to FIG. 4, in a second embodiment of this utility model, the third braided wires 23*a* are only disposed on the wale W11 in the middle of the warp-knit tape 1*a*, and are closely combined with the first and second braided wires 21*a*, 22*a*. In the above structure, the fixing region 3 is reduced in size and used together with smaller buckles, such that the bending degree on the left and right sides is increased, and thus the effect of bilateral bending is achieved.

In addition, the third braided wires of this utility model may not only be disposed at the center of the warp-knit tape as in the above two embodiments, but also disposed closer to one side in the middle of the warp-knit tape, such that the fixing region formed by the third braided wires is at different distances to two sides of the warp-knit tape, so as to support the male and female buckles of various configurations, thereby achieving the same efficacy as the first embodiment.

The above implementation aspects only illustrate this utility model, but are not intended to limiting the utility model, and any variation to the numerical values or replacement of the equivalent components still falls within the scope of this utility model.

In view of the above, it is apparent to those skilled in the art that this utility model can achieve the above objectives. Therefore, the present application is filed according to the provisions of the Patent Law.

| List of Reference Numerals: | |
|---|---|
| 1, 1a | warp-knit tape |
| 21, 21a | first braided wire |
| 22, 22', 22a | second braided wire |
| 23, 23a | third braided wire |
| 3 | fixing region |
| 4 | buckle |

What is claimed is:

1. A bilaterally bendable warp-knit tape, comprising a plurality of first, second, and third braided wires, wherein each of the first braided wires is staggered while extending circularly along a warp direction of the warp-knit tape with a proper distance from a right side to a left side, so as to form a predetermined number of wales on the warp-knit tape;

each of the second braided wires is staggered while extending circularly along the warp direction of the warp-knit tape with a proper distance from the left side to the right side, so as to form a predetermined number of wales on the warp-knit tape; a span distance of lapping from the left side to the right side of the second braided wire is smaller than that of the first braided wire; and the second braided wires on the two sides of the warp-knit tape are lapped by a plurality of braided wires; and more than three third braided wires are disposed in middle of the warp-knit tape, and each of the third braided wires is continuously lapped while extending upward on the corresponding wale in a form of a crochet along the warp direction of the warp-knit tape, so as to form a fixing region having a predetermined width and extending along the warp direction of the warp-knit tape, thereby enabling the warp-knit tape to obtain desired flexibility and extensibility on both sides of the fixing region for bilateral bending.

2. The bilaterally bendable warp-knit tape according to claim 1, wherein each of the first braided wires is lapped between two wales spaced by three stitch lengths.

3. The bilaterally bendable warp-knit tape according to claim 1, wherein each of the second braided wires is lapped between two adjacent wales.

4. The bilaterally bendable warp-knit tape according to claim 1, wherein the fixing region is at an equal distance to the two sides of the warp-knit tape.

5. The bilaterally bendable warp-knit tape according to claim 1, wherein the fixing region is at different distances to the two sides of the warp-knit tap.

* * * * *